US007389809B2

(12) United States Patent
Renkel et al.

(10) Patent No.: US 7,389,809 B2
(45) Date of Patent: Jun. 24, 2008

(54) TOOL FOR PRODUCING CAST COMPONENTS, METHOD FOR PRODUCING SAID TOOL, AND METHOD FOR PRODUCING CAST COMPONENTS

(75) Inventors: Manfred Renkel, Petershausen (DE); Wilfried Smarsly, München (DE)

(73) Assignee: G4T GmbH, Pretzfeld (DE)

( * ) Notice: Subject to any disclaimer, the term of this patent is extended or adjusted under 35 U.S.C. 154(b) by 0 days.

(21) Appl. No.: 10/574,660

(22) PCT Filed: Sep. 23, 2004

(86) PCT No.: PCT/DE2004/002106

§ 371 (c)(1),
(2), (4) Date: May 22, 2006

(87) PCT Pub. No.: WO2005/039803

PCT Pub. Date: May 6, 2005

(65) Prior Publication Data

US 2007/0034350 A1 Feb. 15, 2007

(30) Foreign Application Priority Data

Oct. 9, 2003 (DE) ..... 103 46 953

(51) Int. Cl.
*B22C 1/00* (2006.01)
*B22C 9/04* (2006.01)

(52) U.S. Cl. ..... 164/519; 164/516

(58) Field of Classification Search ..... 164/516–519
See application file for complete search history.

(56) References Cited

U.S. PATENT DOCUMENTS

| | | | | |
|---|---|---|---|---|
| 4,557,316 | A | 12/1985 | Takayanagi et al. | |
| 5,624,604 | A * | 4/1997 | Yasrebi et al. | 516/88 |
| 5,944,088 | A | 8/1999 | Feagin | |

FOREIGN PATENT DOCUMENTS

| | | |
|---|---|---|
| EP | 0 554 198 | 8/1993 |
| JP | 60012247 | 1/1985 |
| JP | 4-300047 | * 10/1992 |

* cited by examiner

*Primary Examiner*—Kuang Lin
(74) *Attorney, Agent, or Firm*—Manabu Kanesaka

(57) ABSTRACT

A tool and method for production of a cast component from molten titanium alloy. The tool includes a casting mold, wherein at least one mold wall area of the casting mold, which comes into contact with the molten titanium alloy, is made of yttrium oxide, magnesium oxide and calcium oxide. The casting mold includes at least first and second layers, the first layer forming a mold wall area which comes into contact with the molten titanium alloy and the second layer forming a backfilling stabilization area for the mold wall area. Both the first layer and the second layer is formed of yttrium oxide, magnesium oxide and calcium oxide. In addition, the second layer, which backfills the first layer, has less yttrium oxide and is more coarsely grained than the first layer.

5 Claims, 1 Drawing Sheet

TOOL FOR PRODUCING CAST COMPONENTS, METHOD FOR PRODUCING SAID TOOL, AND METHOD FOR PRODUCING CAST COMPONENTS

BACKGROUND OF THE INVENTION

The invention relates to a tool for the production of cast components. In addition, the invention relates to a method for the production of such a tool, as well as a method, for the production of a cast component.

The present invention relates to the production of components, in particular gas turbine components, from nonferrous molten metals, in particular from titanium aluminum alloys, in particular from such materials with 43 to 48% percent in weight of aluminum which form an intermetallic phase by a casting method. During casting, molds, so-called casting molds, are used wherein the casting molds have an interior contour which corresponds to the exterior contour of the component to be produced. In principle a distinction is made between casting methods which use non-permanent casting molds and those which use permanent casting molds. With casting methods which use non-permanent casting molds only one component can be produced with one casting mold. With casting methods which use permanent casting molds the casting molds can be used more than once. So-called precision casting among others is one of the casting methods which use non-permanent casting molds. Reference is made here to gravity casting as an example of casting methods which use permanent casting molds. The present invention relates in particular to the so-called precision casting.

Precision casting uses according to the state-of-technology casting molds which are made of highly refractory ceramics. Production of a casting mold for precision casting roughly involves a first step during which a model is provided for the cast component to be produced later with the casting mold wherein the model has a shape similar to the cast component to be produced but with larger dimensions allowing for the measure of shrinkage of the casting material. This model is also called a component wax model. As defined by the state of technology this component wax model is preferably coated several times with a slurry material as well as sanded and if necessary subsequently backfilled so that the casting mold is either available in the so-called compact mold or in the so-called shell mold after the component wax model is melted off. After the component wax model is melted off the thus created, one-piece casting mold is fired. The still molten metal of the cast component to be produced can then be poured into the preferably hot casting mold wherein the produced cast component is dismantled from the casting mold after hardening. The casting mold is hereby lost.

As already stated the casting molds are made as per state of technology from highly refractory ceramic materials such as aluminum oxide, zircon oxide or yttrium oxide with additions of silicon dioxide. An appropriate slurry material is spread on a component wax model using a state-of-technology slurry method. However, casting molds containing additions of silicon dioxide are reactive and cause surface faults during the production of cast components from reactive nonferrous molten metals such as titanium alloys or also titanium aluminum alloys. This can cause surface faults, deviations in dimensions, cracks and the formation of so-called shrinkage cavities on the cast component to be produced. Thus the known state-of-technology casting molds are not suitable for reactive nonferrous molten metals.

SUMMARY OF THE INVENTION

Based on this assumption, the invention here is concerned with the problem of creating a new type of tool for the production of cast components, a method for the production of such a tool and a method for the production of a cast component.

According to the invention there exists at least one area of the casting mold made of yttrium oxide, magnesium oxide and calcium oxide which comes into contact with the reactive nonferrous molten metal.

According to an advantageous further development of the invention, the casting mold has a construction of at least two layers wherein a first layer forms a mold wall area which comes into contact with the reactive nonferrous molten metal and a second layer forms a backfilling stabilization area for the mold wall area. Both the first layer and the second layer consist of yttrium oxide, magnesium oxide and calcium oxide wherein the second layer which backfills the first layer has less yttrium oxide and is more coarsely grained than the first layer.

Preferred further developments of the invention result from the dependent subclaims and the following description. An example of the invention will now be described in more detail based on the drawing. The drawing shows:

DETAILED DESCRIPTION

Figure 1:
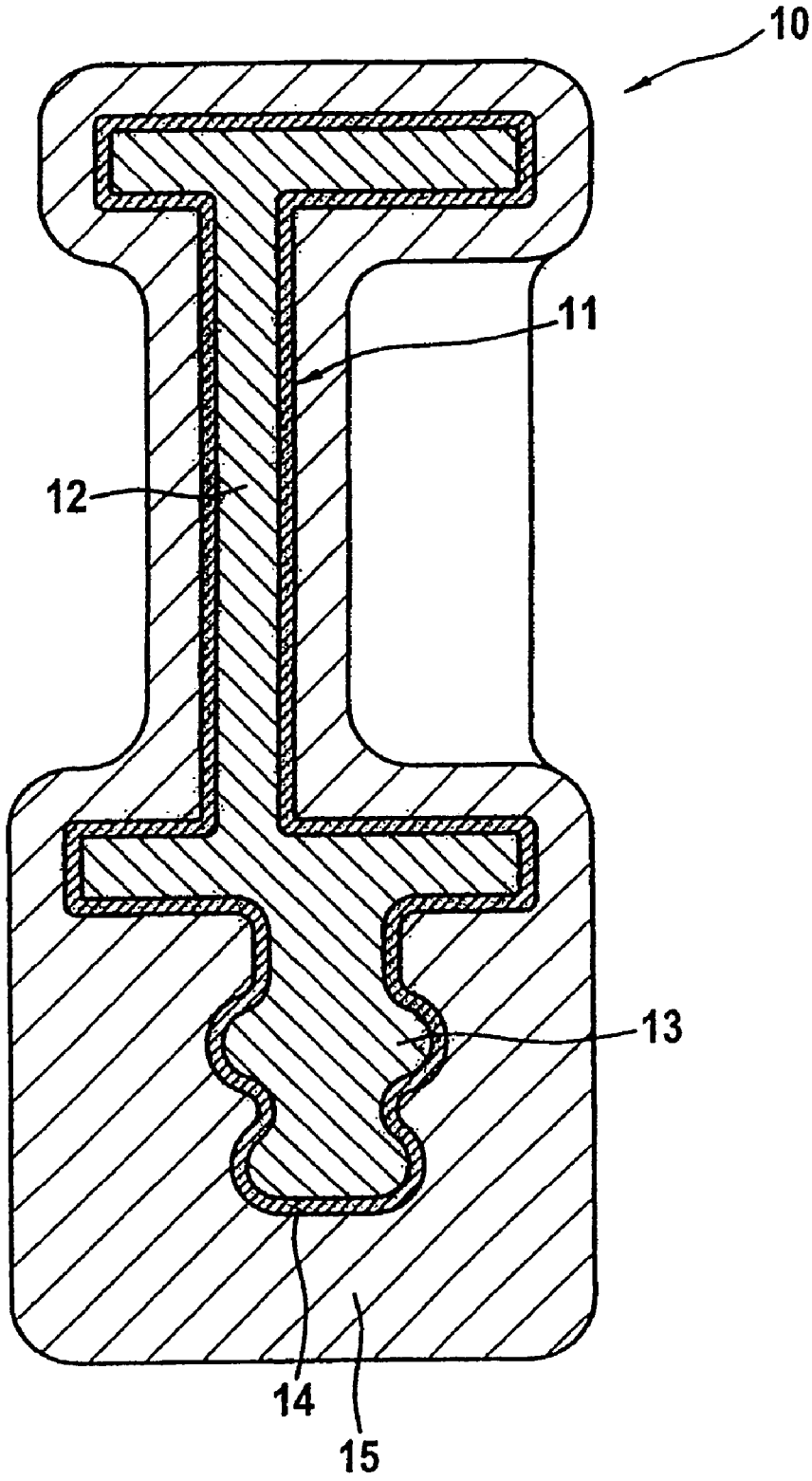
FIG. 1 A cross section of the casting mold as provided by the invention for a gas turbine blade together with a gas turbine blade produced by casting.

The invention here will now be described in greater detail with reference to FIG. 1. FIG. 1 shows a cross section of a casting mold 10 together with a gas turbine blade 11 produced by casting wherein the gas turbine blade 11 encompasses a blade paddle 12 and a blade foot 13. The gas turbine blade 11 produced by casting is surrounded by casting mold 10.

The example shows the casting mold as a two-layer construction. A first layer 14 of the casting mold 10 forms a mold wall area which comes into contact with the reactive nonferrous molten metal of the cast component to be produced. A second layer 15 of same forms a backfill for the first layer 14.

In the sense of the invention here at least the first layer 14 of the casting mold 10, which comes into contact with the reactive nonferrous molten metal of the gas turbine blade 11 to be produced, consists of yttrium oxide, magnesium oxide and calcium oxide. With such a composition of the casting mold 10, reactions between the casting mold and the reactive nonferrous molten metal are avoided at least in the area of the first layer 14 so that deviations in dimensions and cracking on the cast component to be produced, namely the gas turbine blade 11 to be produced, are avoided.

In the example shown here, not only the first layer 14 but also the second layer 15 of the casting mold 10 consists of yttrium oxide, magnesium oxide and calcium oxide. However, the second layer 15 which provides the backfilling has a considerably lower yttrium oxide content than the first layer 14 which comes into contact with the reactive nonferrous molten metal of the gas turbine blade 11 to be produced. In addition to this the second layer 15 is more coarsely grained and has thicker walls than the first layer 14. For cost and production reasons this is particularly advantageous.

For the production of the casting mold the invention states that a component wax model must be provided which has approximately the same geometrical dimensions as the cast component to be produced with the casting mold. The component wax model is coated with a slurry material wherein the slurry material consists of water, yttrium oxide, magnesium oxide and calcium oxide.

In the example shown here, the casting mold 10 to be produced has two layers. Accordingly, in a first step of the method as provided by the invention for the production of the casting mold 10 shown in FIG. 1, the component wax model is first preferably coated with the slurry material in such a way that the first layer 14 of the casting mold is formed. Subsequently the preferably multiple-layer coating of the first layer 14 with the second layer 15 follows wherein the second layer 15 provides the backfilling for the first layer 14. Appropriately adapted slurry materials are provided for the production of the first layer 14 and the second layer 15 wherein both slurry materials consist of water, yttrium oxide, magnesium oxide and calcium oxide. However the slurry material for the formation of the second layer has a lower yttrium oxide content and is more coarsely grained than the slurry material for formation of the first layer 14.

As already stated, the yttrium oxide and the magnesium oxide prevent an undesired reaction of the nonferrous molten metal of the cast component to be produced with the casting mold 10. Together with the water of the slurry material the magnesium oxide causes an exothermal reaction during which the water is vaporized. This significantly reduces the drying time of layers 14 and 15 of the casting mold 10. The slurry material binds similarly to the way concrete binds. The firing temperature for the casting mold can be reduced from approx. 1400° C. to approx. 900° C. wherein the casting temperature is also about 900° C. This makes the production of casting molds quick, simple and inexpensive.

The first layer 14 which has the higher yttrium oxide content and is more finely grained has thinner walls than the second layer 15 which provides the backfilling. The thin first layer 14 suppresses undesired reactions between the casting mold and the nonferrous molten metal. The second layer 15 gives sufficient mechanical strength to the casting mold and provides same with a high thermal capacity which allows the casting mold to cool slowly and permits a casting temperature of approx. 900° C. The mechanical strength minimizes distortion from shrinkage and the high thermal capacity causes a micro-plastic ductility of the otherwise brittle material to be cast so that no cracks or breaks appear in the component.

With the aid of the casting mold provided by the invention a shrinkage-cavity-free solidification of the reactive nonferrous molten metal of the cast component to be produced is possible. The casting mold can be filled by so-called centrifugal casting. Particularly when centrifugal casting is used it is advantageous to use molds which can be heated by microwave radiation or inductive coupling. Metal particles, metallic structures, in particular metal meshes, as well as semiconducting and conducting nonmetals, in particular graphite or silicon, can be incorporated in the layer(s) of the mold.

Furthermore it is within the purpose of this invention to provide the casting mold 10 with a changing thickness, in particular in the area of the second layer 15. FIG. 1 shows that the second layer 15 is much thicker in the area of the blade foot 13 than in the area of the blade paddle 12. In addition to this the thickness of the casting mold can also be varied by making the walls of the casting mold thinner at the top of the blade paddle 12 than in the lower area which is adjacent to the blade foot 13. This causes the nonferrous molten metal to solidify directionally and the solid-liquid interface to end in the area of the blade foot.

The casting mold provided by the invention is particularly suitable for the production of gas turbine components such as blades which are made from a titanium aluminum alloy, in particular titanium aluminides with 43 to 48% percent in weight of aluminum which form intermetallic phases. For this a titanium aluminum molten alloy is poured into the above described casting mold wherein the cast component is removed from the casting mold after solidification.

The invention claimed is:

1. A tool for production of a cast component from molten titanium alloy, comprising a casting mold, wherein the casting mold comprises at least first and second layers, the first layer forming a mold wall area that comes into contact with the molten titanium alloy and the second layer forming a backfilling stabilization area for the mold wall area;

wherein both the first layer and the second layer consist essentially of yttrium oxide, magnesium oxide and calcium oxide; and wherein the second layer, which backfills the first layer, has less yttrium oxide and is more coarsely grained than the first layer.

2. A tool as defined in claim 1, wherein the second layer has walls thicker than the first layer.

3. A method for production of a casting mold for a cast component from molten titanium alloy, comprising the steps of:

providing a component wax model which has geometrical dimensions of a precision-casting component to be produced with the casting mold, coating the component wax model with a slurry material consisting essentially of water, yttrium oxide, magnesium oxide and calcium oxide, wherein the slurry material is spread in multiple layers on the component wax model in such a way that the casting mold with at least a two-layer construction is created wherein a first layer of the casting mold forms a mold wall area which comes into contact with the molten titanium alloy, and a second layer of the casting mold forms a stabilization area which backfills the mold wall area, drying and hardening the coating for the casting mold, and removing the component wax model from the casting mold, wherein the slurry material for formation of the second layer which backfills the first layer has less yttrium oxide and is more coarsely grained than the slurry material for formation of the first layer.

4. A method for production of a cast component from a molten titanium alloy, comprising the steps of:

providing the casting mold as defined in claim 3, filling the molten titanium alloy into the casting mold, solidifying the molten titanium alloy in the casting mold, and removing the cast component from the casting mold.

5. The method as defined in claim 3, wherein a titanium aluminum molten alloy is filled into the casting mold to produce a gas turbine component.

* * * * *